United States Patent [19]

Riss

[11] Patent Number: 5,019,116

[45] Date of Patent: May 28, 1991

[54] SEWING MACHINE APPARATUS FOR THE SUCCESIVE PRODUCTION OF A NUMBER OF STITCH GROUPS IN A WORKPIECE

[75] Inventor: Gerhard Riss, Bielefeld, Fed. Rep. of Germany

[73] Assignee: Durkoppwerke GmbH, Fed. Rep. of Germany

[21] Appl. No.: 361,375

[22] Filed: Jun. 5, 1989

[30] Foreign Application Priority Data

Jun. 7, 1988 [DE] Fed. Rep. of Germany ..... 3819277

[51] Int. Cl.[5] ..... D05B 21/00

[52] U.S. Cl. ..... 112/121.14; 112/70; 112/104

[58] Field of Search ..... 112/121.14, 70, 76, 112/65, 67, 264.1, 121.11, 311, 104, 114, 121.27

[56] References Cited

U.S. PATENT DOCUMENTS

| | | | |
|---|---|---|---|
| 3,974,786 | 8/1976 | Bianchi | 112/121.27 X |
| 4,327,653 | 5/1982 | Blessing | 112/121.14 |
| 4,481,895 | 11/1984 | Asao et al. | 112/67 X |
| 4,669,404 | 6/1987 | Yoneda | 112/70 X |
| 4,669,405 | 6/1987 | Resta et al. | 112/103 X |
| 4,696,242 | 9/1987 | Scholl et al. | 112/121.14 |

FOREIGN PATENT DOCUMENTS 2166170A 10/1985 United Kingdom .

*Primary Examiner*—Peter Nerbun

*Attorney, Agent, or Firm*—Ostrolenk, Faber, Gerb & Soffen

[57] ABSTRACT

In the sewing unit for the successive production of a number of stitch groups in a workpiece, a carriage supported slidably in two opposite directions on a frame and bearing a stitch group sewing machine. The sewing unit is periodically driven by a drive unit back and forth. A clamping device, slidably supported on the frame, is periodically coupled to the carriage by a clutch unit. The stitch group sewing operation takes place during the synchronous motion of the stitch group sewing machine and the clamping device. When the sewing operation is completed and the carriage is at rest, a pushing device attached to the frame pushes the clamping device, once it has been uncoupled from the carriage, in the opposite direction to its previously executed motion, back into its initial position.

10 Claims, 10 Drawing Sheets

SEWING MACHINE APPARATUS FOR THE SUCCESIVE PRODUCTION OF A NUMBER OF STITCH GROUPS IN A WORKPIECE

BACKGROUND OF THE INVENTION

1. Field of the Invention

The present invention relates to sewing machines and more particularly to a sewing unit for successive or repetitive production of a number of stitch groups in a single workpiece. For example, the unit is applicable to the sewing of successive groups of buttons or buttonholes, where an automatically operated device is adapted to sew such buttons or buttonholes which are arranged in a group on a workpiece, which device in turn is mounted in a frame in a sewing machine.

A carriage which is supported on a frame in a sewing machine is intermittently displaceable in opposite directions. The carriage carries a stitch group sewing machine which is equipped with a liftable material presser. The carriage is provided with a clamping device which is located in the zone of operation of the sewing elements for the stitch group to temporarily hold the workpiece positively clamped in a position. A feed device is provided having a mark for aligning, receiving and placement of the workpiece that is to be sewn. A removal device is provided for removing a sewn workpiece from the clamping device. A control, which is preferably electropneumatic, has a drive unit which periodically drives the stitch group sewing machine in a selected direction, back or forth, by means of a tension transmission. The clamping device is slidably supported on the frame and can be periodically engaged by the carriage by means of a clutch unit. A pushing device is also provided that pushes the clamping device in a direction opposite to its previously executed movement into an initial operating position after the completion of the stitch group sewing operation.

2. Background Art

Sewing units for successive production of a number of stitch groups in a workpiece are known, for instance in German Patent 26 50 334. In such sewing units, the buttonholes near the front edge of a shirt front or blouse front are held under tension and are sewn in an efficient manner because they are over-lapped. For this purpose, the stitch group sewing machine is moved between two sewing operations along the essentially stationary clamping device from a position at the buttonhole that has just been sewn up to a position at which the next buttonhole is to be sewn. The stitch group sewing machine is thus moved intermittently in one direction up to the last buttonhole to be sewn. During the sewing of buttonholes, a workpiece that is subsequently to be sewn is manually placed in the feed device. As soon as the removal device has removed the previously sewn workpiece from the clamping device, the feed device automatically transfers the next workpiece to the clamping device. In order to be able to sew buttonholes on that next workpiece, the stitch group sewing machine is now moved in the opposite direction, relative to the above mentioned sewing operation. While it is sewing the first workpiece, if the stitch group sewing machine is moved, for instance, in the direction U, then while it is sewing the next sewing piece, it moves in the direction V. The reversal of motion of the stitch group sewing machine avoids idle strokes. Furthermore, overlapping by placing the second workpiece in the feed device while the first workpiece is being sewn, high productivity is achieved in a known sewing unit.

However, the known unit has the disadvantage that the above described movement of the stitch group sewing machine from buttonhole to buttonhole is executable only between two sewing operations, so that the time required for said motion must be described as unproductive idle time.

SUMMARY OF THE INVENTION

It is therefore the object of the invention to improve a sewing unit of the type described so that the unproductive idle time can be reduced to a minimum.

This object is accomplished by the above described means including the feed device for aligned receiving and subsequent placing of the workpiece to be sewn, the removal device for the removal of the sewn workpiece from the clamping device, and the electropneumatic control which includes a drive unit which drives the stitch group sewing machine in the directions U or V by means preferably in a tension transmission. The clamping device is slidably supported on the frame and a clutch is provided to periodically engage and disengage the clamping device. The clamping device is pushed in a direction opposite to its previously executed movement and into its initial position after completion of the stitch group sewing operation.

With the sewing unit of the invention, it is possible to periodically move the clamping device in either of directions U or V synchronously with the stitch group sewing machine, with simultaneous performance of the stitch group sewing operation. This is possible because the stitch group sewing machine and the clamping device are at rest relative to each other during the above mentioned movement By the logical superimposing of the stitch group sewing operation on the change in position of the stitch group sewing machine, which is required for the sewing of two stitch groups spaced a distance apart, and by the oppositely directed motion of the clamping device into its initial position, which is carried out during the sewing pause, unproductive idle times in the successive production of a number of stitch groups in a workpiece can be greatly minimized.

BRIEF DESCRIPTION OF THE DRAWINGS

The foregoing and other objects and features of the present invention will become apparent in the following description and accompanying drawings in which.

DESCRIPTION OF THE PREFERRED EMBODIMENT

Figure 1:
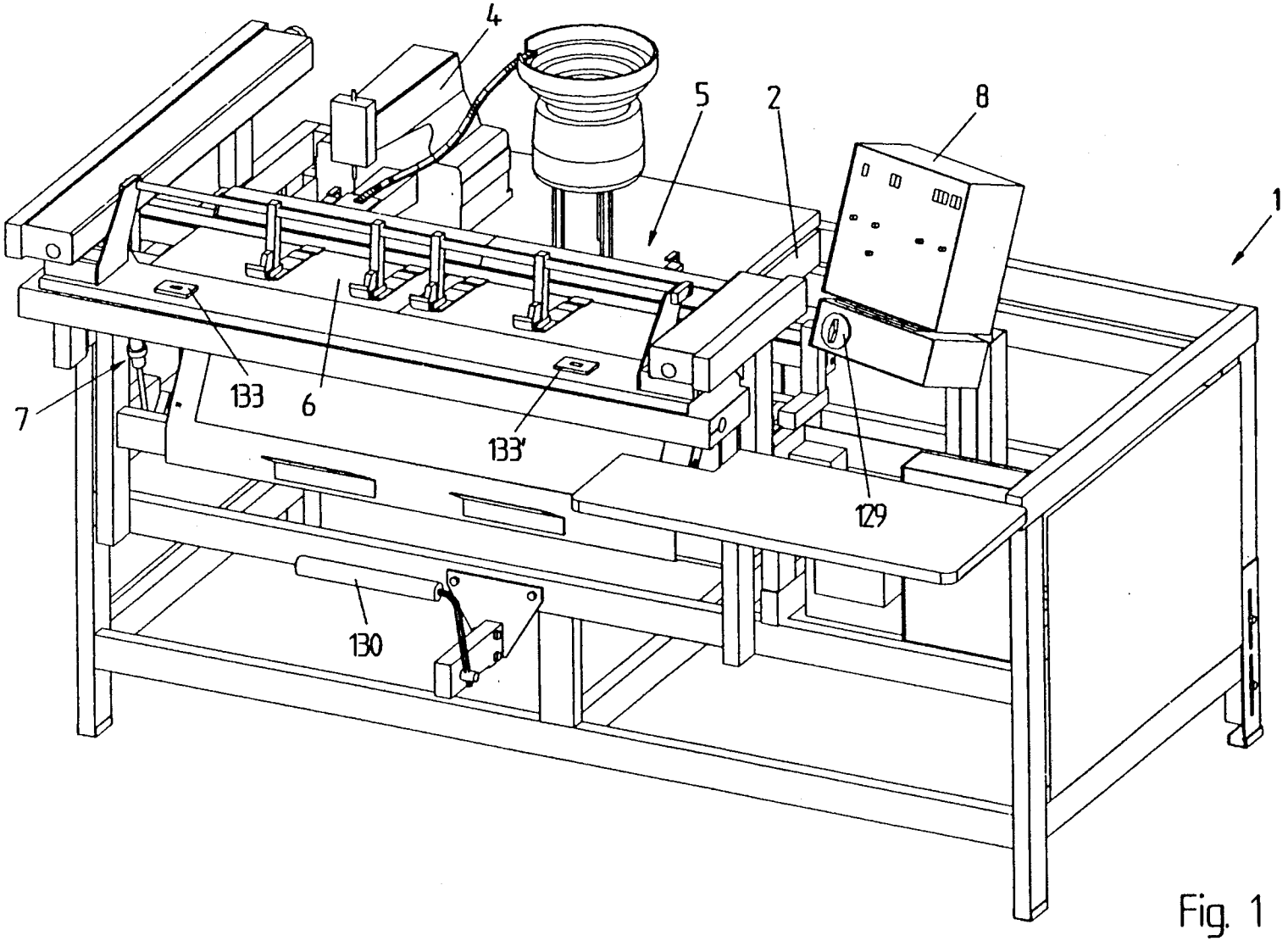
FIG. 1 is a view in perspective of the complete sewing unit.

FIGS. 1-4 illustrate a sewing unit for the successive production of stitch groups in a workpiece, for example, a shirt front or a blouse front. The sewing unit comprises a frame 1, a carriage 2 supported slidably on the frame, a plate 3 attached to the carriage 2 and to which a stitch group sewing machine 4, e.g. an automatic button-sewing machine or an automatic buttonholing machine, is attached, a clamping device 5 slidably supported on the frame 1, a workpiece feed device 6, a workpiece removal device 7, an electropneumatic control 8, a dive unit 9, a tension transmission 10, a clutch unit 11, and a pushing device 12.

Figure 2:
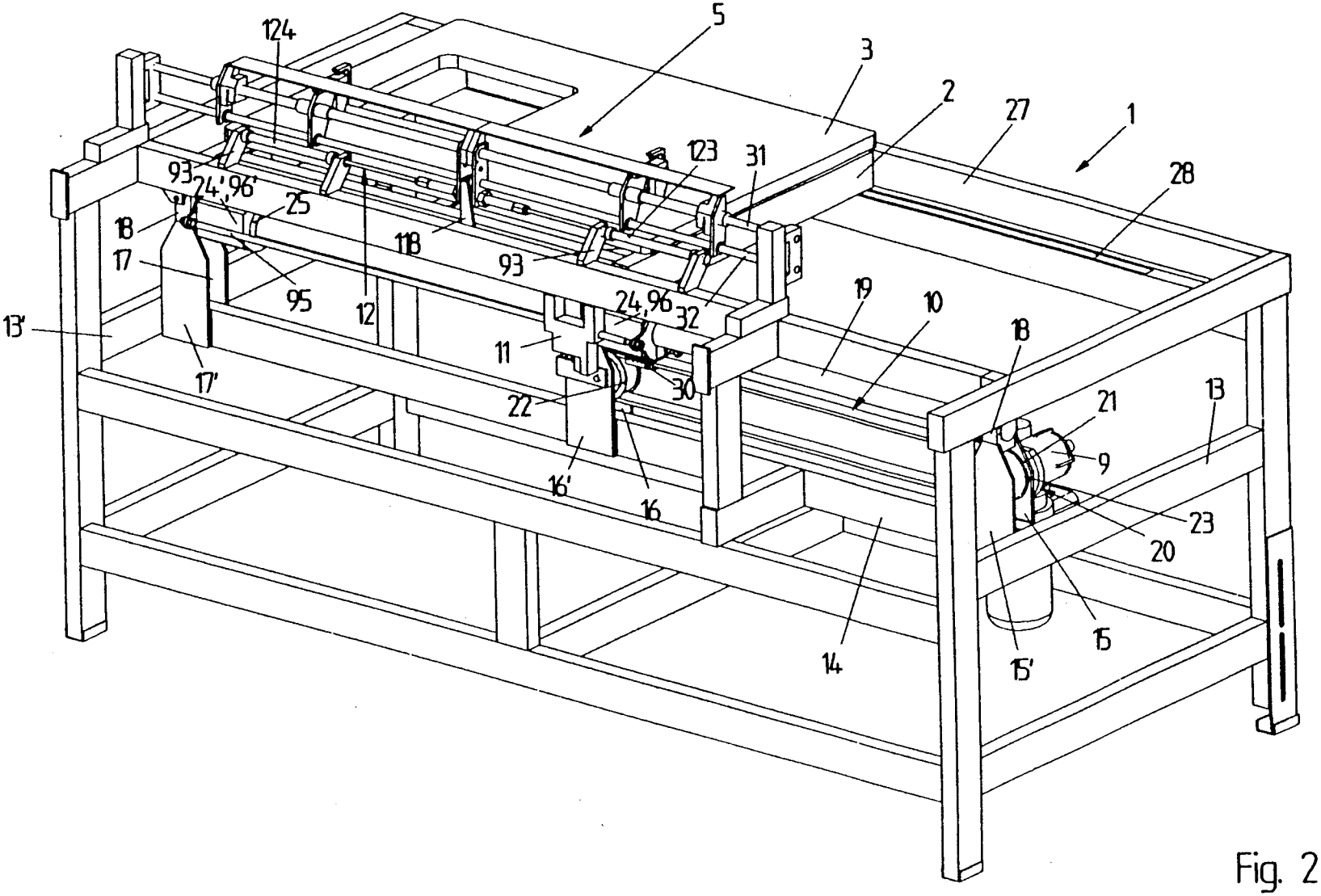
FIG. 2 is a schematic view in perspective of the operating components of the sewing unit of the invention.

The frame 1 is constructed essentially of rectangular hollow profiles and provides support for the complete sewing unit. Firmly connected to the opposite side members 13, 13' is a girder 14. At spaced intervals along the girder, pairs of bearing plates 15, 15', 16, 16', 17, 17' are attached (FIG. 2). The bearing plate pairs 15, 15' and 17, 17' accommodate between them a respective bearing bracket 18. A hollow shaft 19 is immovably supported in known manner between the end bearing brackets. The drive unit 9 is firmly connected to the bearing plate 15. That unit is preferably a frequency controlled alternating current gear motor with a low drive shaft rotation speed. Attached to an output stub shaft 20 from the motor is a toothed belt pulley 21, which is located between the bearing plates 15, 15' in FIG. 2. A further toothed belt pulley 22 is rotatably supported between the bearing plates 16, 16'. The two toothed belt pulleys 21, 22 are connected by a toothed belt 23 which passes around them and thus forms the tension transmission 10.

On its bottom, the carriage 2 has two axially spaced apart bearing brackets 24, 24'. Into each bracket a commercial slide bush 25 is pressed. By means of the bearing brackets 24, 24' and the slide bushes 25, the carriage 2 is slidably supported on the hollow shaft 19. Furthermore, at least one rotatable travel roller 26 (FIG. 3), preferably a commercial ball bearing, is provided on the back of the carriage 2 which rolls on a travel strip 28 that is attached to a transverse member 27. This enables easy sliding of the carriage 2.

A clamp holder 29 (FIG. 3) is firmly connected to the carriage 2. A jaw 30 is provided on the bottom of the clamp holder. The toothed belt 23 is located between the clamp holder 29 and the jaw 30. The top of the jaw has a shape corresponding to the toothed belt 23. By the positive coupling of the toothed belt to the carriage 2, slip free sliding motion of the carriage is made possible.

Figure 3:
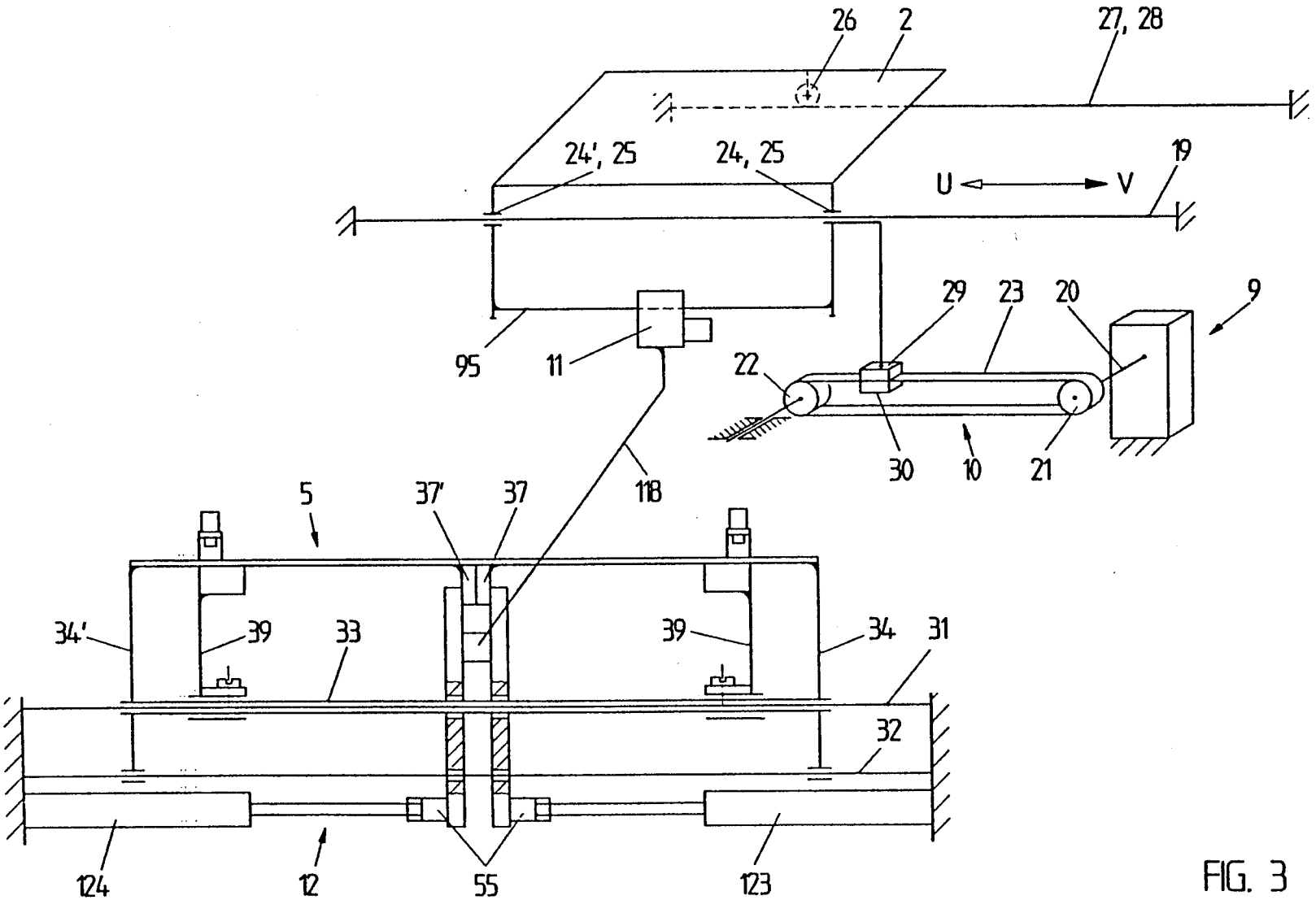
FIG. 3 is a schematic representation showing the cooperation of the components of the device describing the operation of the present invention.
Figure 6:
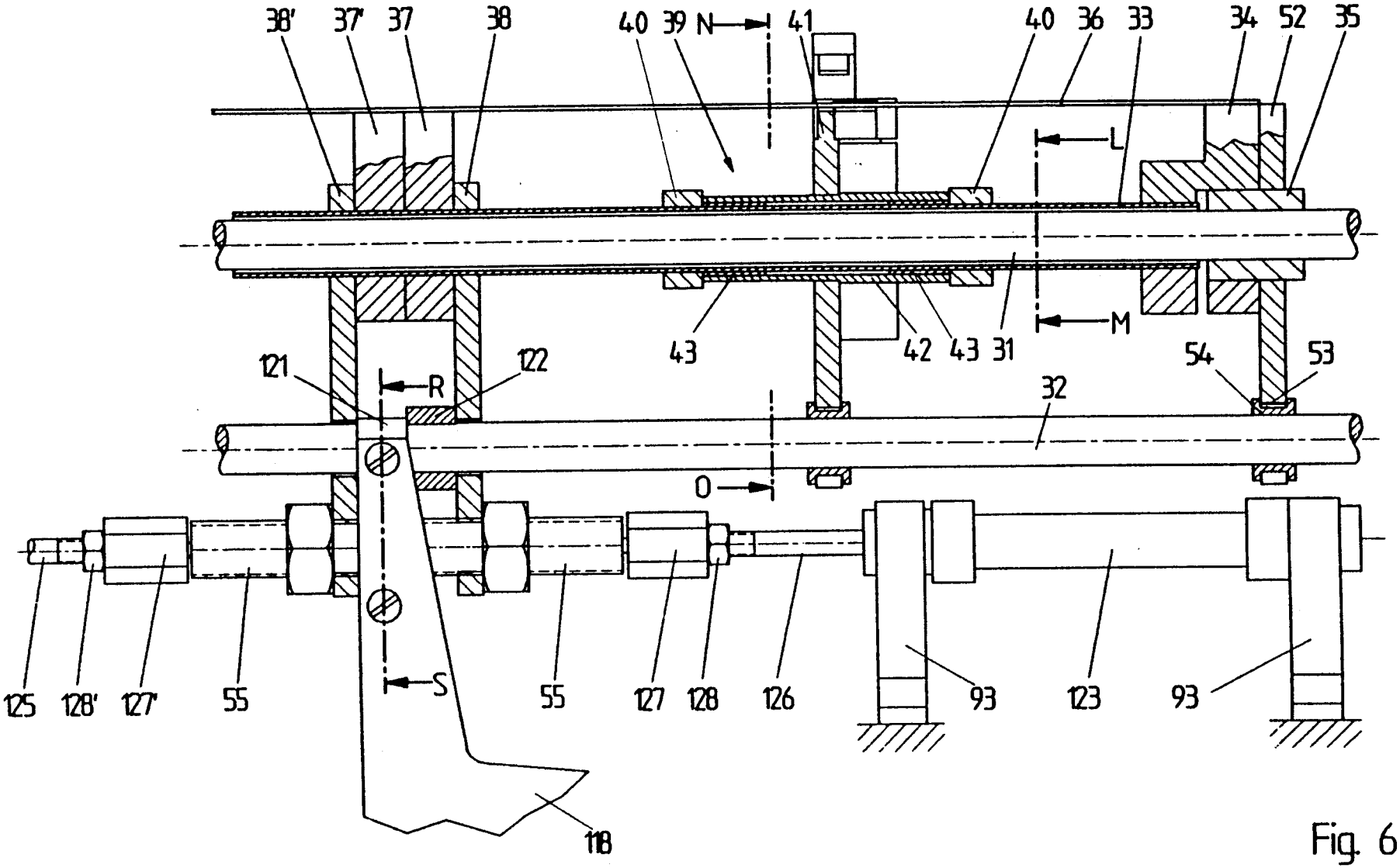
FIG. 6 is a longitudinal section of the right-hand half of the clamping device.
Figure 7:
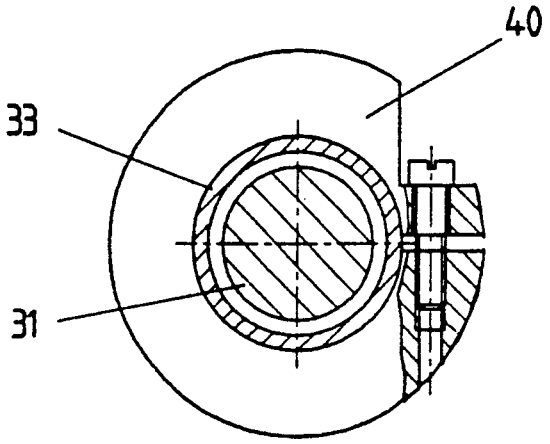
FIG. 7 is a cross-section taken along the section line L-M of FIG. 6.

Referring to FIGS. 2 and 3, two vertically spaced, parallel guide rods 31 and 32 are firmly connected to the frame 1. The clamping device 5 is slidably supported on both rods. FIG. 6 shows the clamping device The left side of the clamping device 5 is a mirror image of the right side shown in FIG. 6. On each of the two ends of a supporting tube 33 there is provided a clamp bracket 34, 34'. Both of these brackets are connected in force locked manner to the supporting tube 33 by a clamp connection, shown schematically in FIG. 6. A slide bush 35 is pressed into the other end of each of the clamp brackets 34, 34'. A bearing plate 36 is attached to the clamp brackets 34, 34' by means of commercially available countersunk screws, not shown. Also attached to the bearing plate 36 are two supporting plates 37, 37', which are arranged centrally between the clamp brackets 34, 34'. By means of known connecting elements, not shown, a driver plate 38 is attached to the supporting plate 37 and another driver plate 38' is attached to the further supporting plate 37'. Two slides 39 are slidably arranged on the supporting tube 33. One of the slides is located between the driver plate 38 and the clamp bracket 34, and the other is located between the driver plate 38' and the clamp bracket 34'. The slides 39 can be firmly fixed on the supporting tube 33 by means of two clamp rings 40, shown in FIG. 7. On the other hand, the firm fixing of the slides can also be achieved by means of a screw connection on the slide 39, according to FIG. 3, or by means of two commercial adjustment rings which are provided in place of the clamp rings 40 shown in FIG. 6. It is obvious to the man skilled in the art that in the case of the two last named possibilities of fixing on the supporting tube 33, an appropriately embodied screw on surface, not shown here, must be provided.

Figure 8:
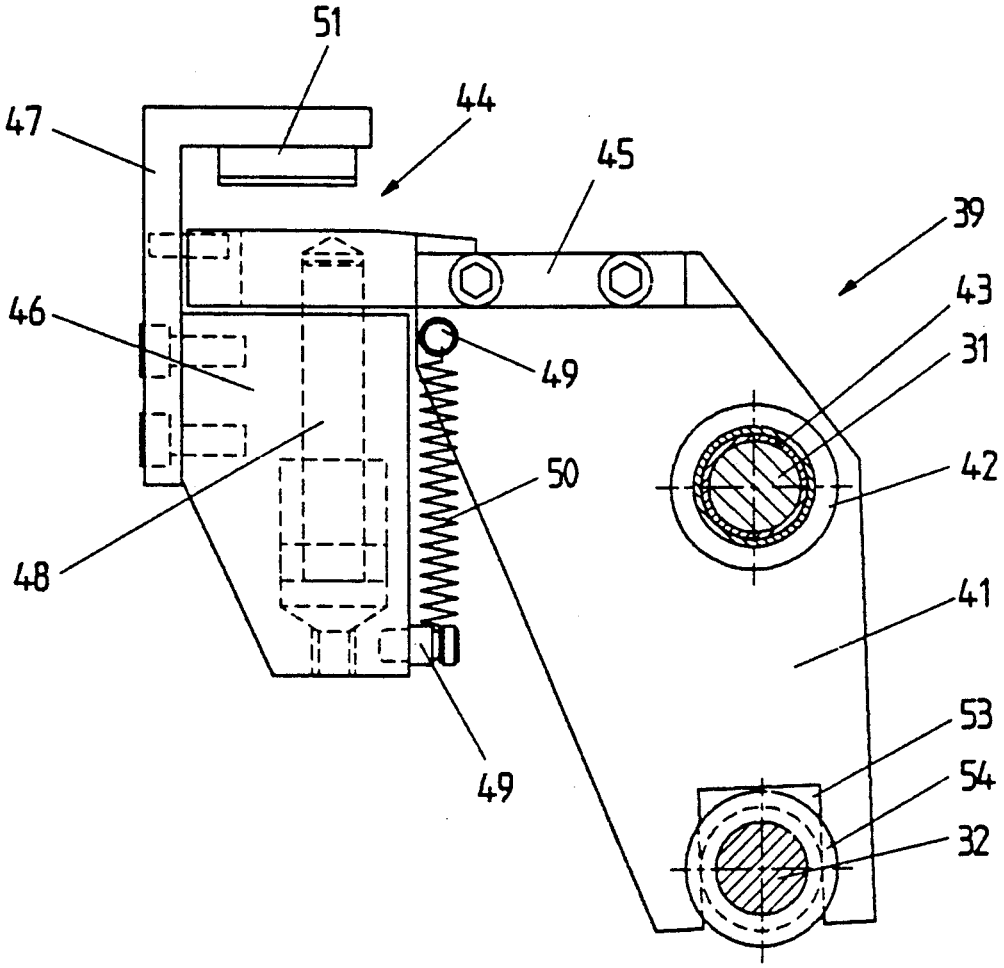
FIG. 8 is a side view of the slide along the cross-section line N-0 of FIG. 6.

The slide 39 is comprised of a plate 41 and a sleeve 42 firmly connected to the plate. Two slide bushes 43 are pressed into the sleeve. Referring to FIG. 8, a sewing material holder 44 is attached to each slide 39. The holder is comprised of a leg 45, a single acting compressed air cylinder 46 and a holding finger 47. In the leg 45 attached to the plate 41, a piston rod 48 of the compressed air cylinder 46 is fastened in a well known manner according to FIG. 8.

The holding finger 47 is attached to the compressed air cylinder, for example, by two commercial countersunk screws. Two pins 49 are pressed into the plate 41 and into the compressed air cylinder 46. Between the pins there is tension spring 50. Its preferably resilient material is provided on the bottom of the holding finger 47.

An end plate 52, 52' is attached to the outward facing side of each of the clamp brackets 34, 34'. These end plates, like the plates 41, have a fork-shaped opening 53 on their bottoms. Each of the openings 53 receives a slide ring 54, which was preferably fabricated from a polyamide and which was pushed onto the guide rod 32, as in FIGS. 6 and 8. A shock absorber 55 is attached to each of the driver plates 38, 38' in a known manner.

Figure 4:
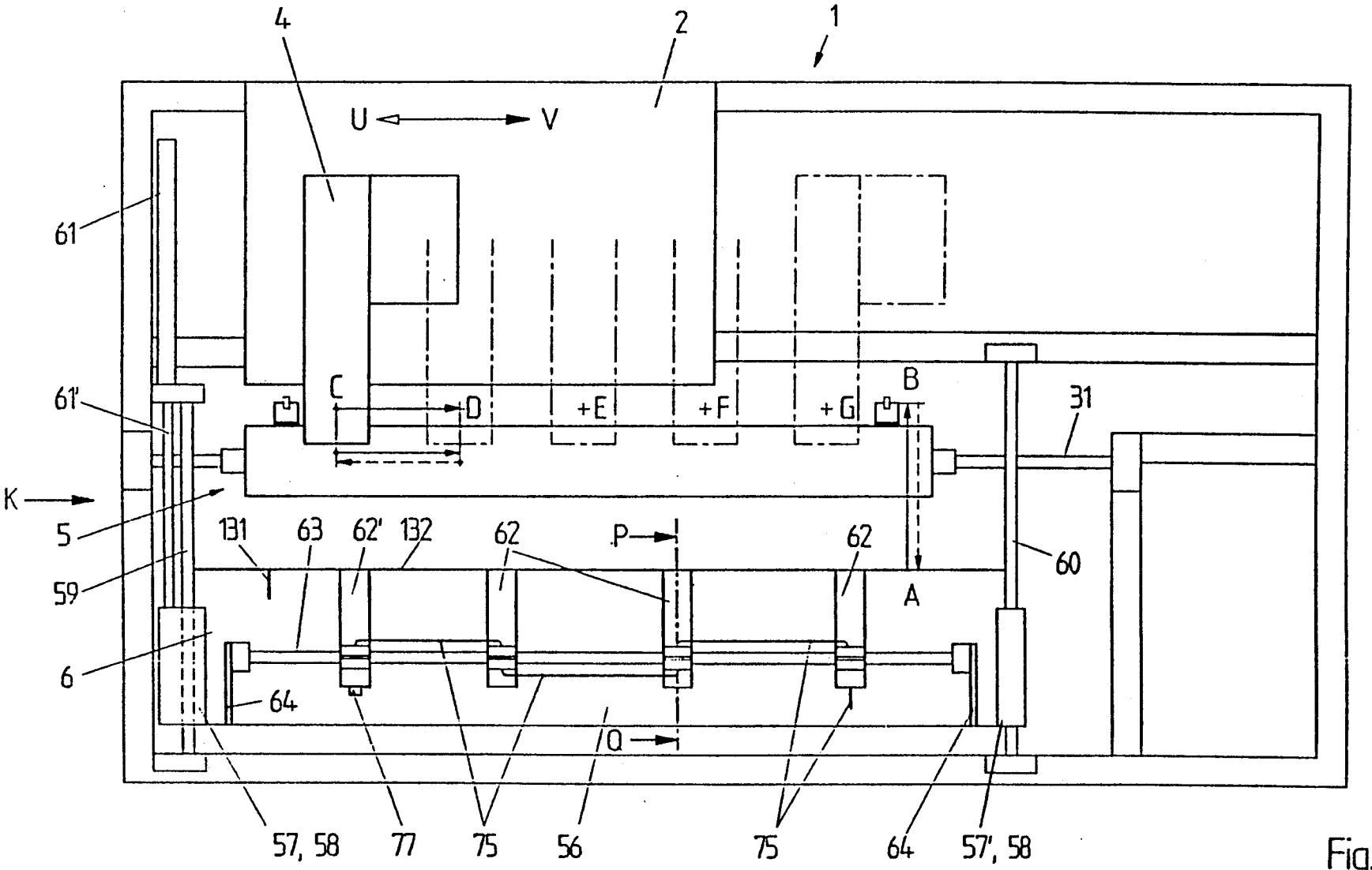
FIG. 4 is a schematic, simplified plan view of the sewing unit.

The feed device 6 is known in principle and is only briefly described here. In FIG. 4, it comprises a layout table 56 having transverse sides to which the bearing brackets 57, 57' are attached Both brackets are provided with slide bushes 58 in known manner. The layout table 56 is slidably supported by the bearing brackets 57, 57' and the slide bushes 58 on respective guide rods 59, 60 fixed to the frame. The sliding motion of the layout table 56 from its initial position A to its advanced position B and vice versa is caused by a double-acting compressed air cylinder 61, which is fixed to the frame. Its piston rod 61' is firmly connected to the bearing bracket 57.

Figure 9:
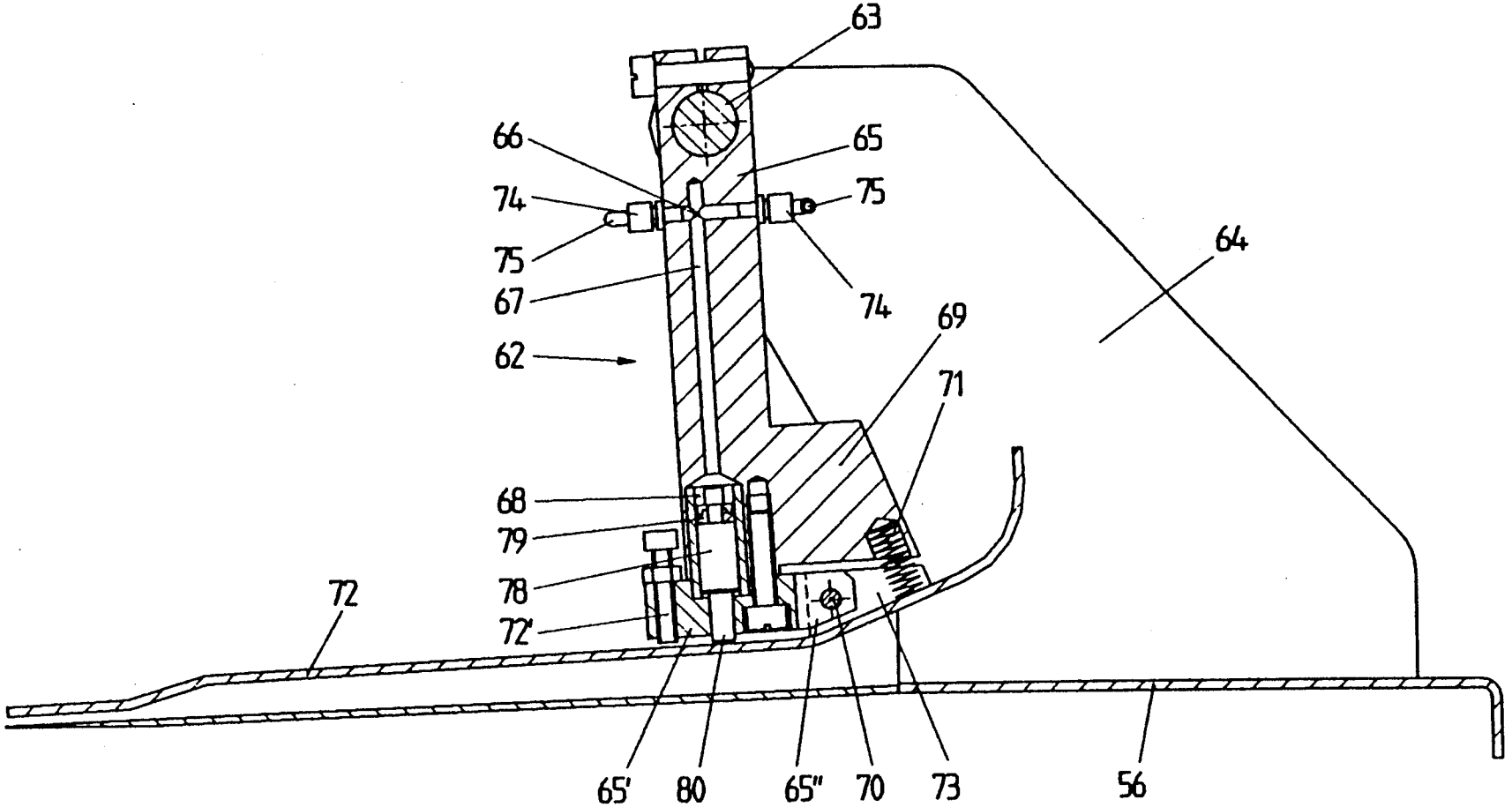
FIG. 9 is a cross-sectional view taken along the section line P-Q of FIG. 4.

Several clamps 62, 62' are provided for firmly holding a workpiece which has been placed in the feed device 6 and been previously aligned. The design and operation of these clamps can be noted from FIG. 9. The clamps 62, 62' are slidably supported on a rod 63 and are connected in force-locked manner to the rod 63 by means of a clamp connection. The rod 63 is attached to the layout table 56 via two brackets 64. The clamp 62, 62' is comprised of a supporting body 65 having a transversely directed threaded hole 66 which is intersected by a longitudinal hole 67. In the bottom part of the supporting body 65, the longitudinal hole 67 opens into a cylindrical hole 68. An enlargement 69 provided on the supporting body 65 receives a compression spring 71 in a blind hole.

An end piece 65' is attached to the bottom end of the supporting body 65. It has a protruding tongue 65''. A sole plate 72 has two upwardly directed legs 73, which receive the tongue 65'' between themselves in known manner. By means of a pin 70, the sole plate 72 is pivotably connected to the end piece 65'' and thus also to the supporting body 65. The pivoting of the sole plate 72 is limitable by means of an adjustment screw 72'.

Two commercial threaded hose connections 74 are provided in the supporting body 65 of the clamps 62, while in the supporting body 65 of the clamp 62' there are a threaded hose connection 74 and a blind plug 77.

The clamps 62, 62' are connected to an external source of compressed air via hose pieces 75. A plunger 78 is supported in the cylindrical hole 68. On the top of the plunger there is a commercial lipped seal ring 79 and on the bottom of the plunger there is a pin 80.

Figure 5:
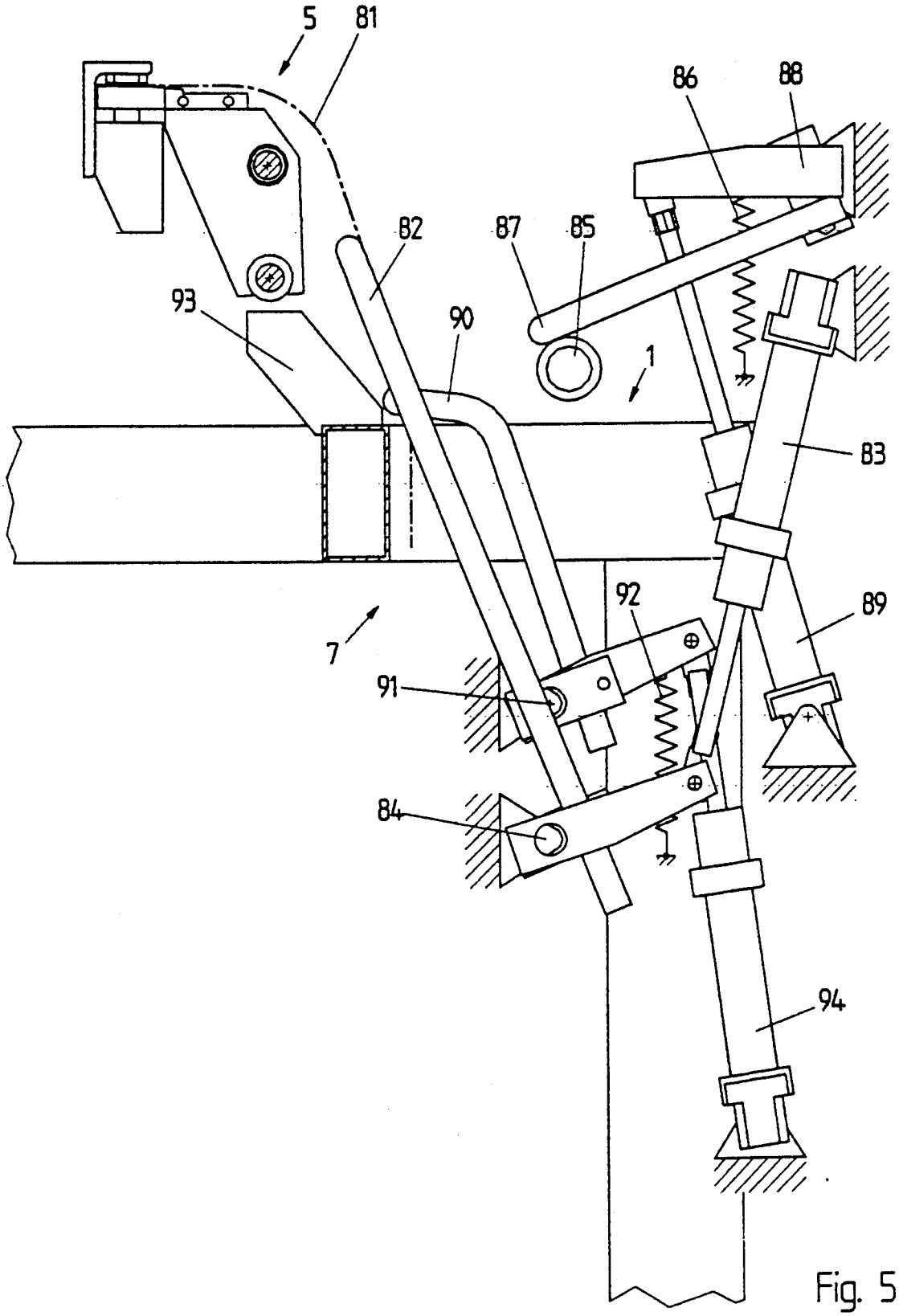
FIG. 5 is a simplified side view taken in the direction of the arrow K of FIG. 4 from which the manner of operation of the removal device can be seen.

In FIG. 5, the removal device 7 automatically removes a finally sewn workpiece from the clamping device 5. The finished workpiece 81 is withdrawn from the clamping device 5 by a swingable throw-over part 82, which can be periodically swung by a double-acting compressed air cylinder 83 around a pivot 84 which is fixed to the frame. The throw-over part 82 is a component of a device already known from German Patent 20 57 041 for the stacking of flexible workpieces, and it also finds use in the sewing unit described here. The stacking device in FIG. 5 comprises a stacking material carrier 85 which is supported in the frame 1. Against the carrier 85, a clamp member 87 is urged by a tension spring 86. The clamp member is supported swingably about a bearing point 88 on the frame 1. By charging of a single acting compressed air cylinder 89, the clamp member 87 can be lifted from the stacking material carrier 85. Finally, the stacking device has a further clamp member 90, which is arranged swingably around a pivot point 91 fixed to the frame. In its rest position, under the action of a further tension spring, the clamp member 90 rests against several arms 93 attached to the frame 1. By charging a further single-acting compressed air cylinder 94, the clamp member 90 swings until it stops against the stacking material carrier 85.

Figure 10:
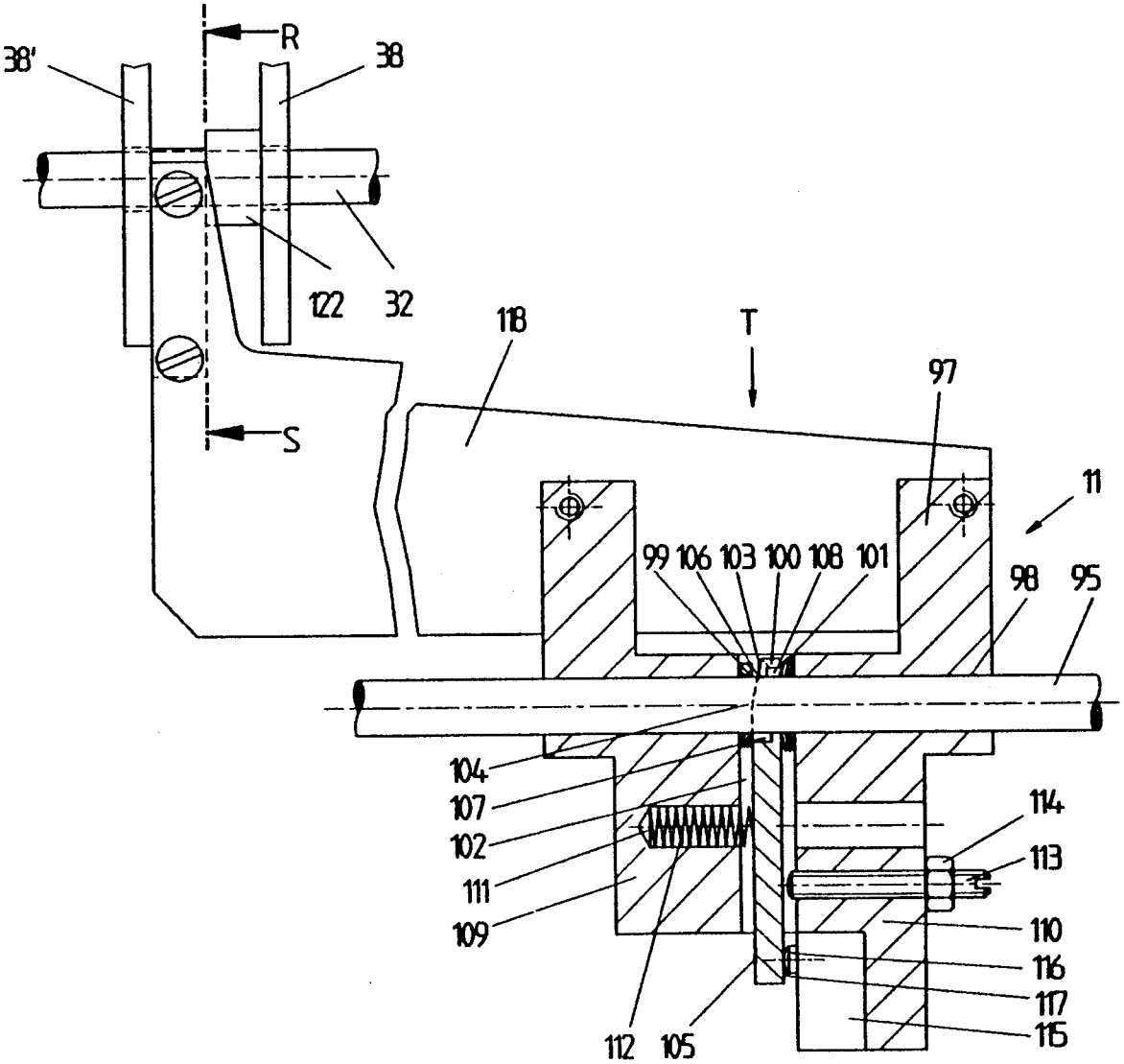
FIG. 10 is a sectional view taken through the clutch unit.

In FIGS. 2 and 10–12, a connecting rod 95 is attached to the carriage 2 (FIGS. 2 and 3) in the vicinity of two end faces 96, 96' provided on the bearing brackets 24, 24'. The clutch unit 11 of FIG. 10 is supported on this connecting rod 95 in an easily operated but play free manner. The clutch unit comprises a U-bracket 97 having a hole 98 which receives the connecting rod 95 and additional components associated therewith, through which the connected rod 95 passes. These additional components include a ring 99, a clutch lever 100 and several plate springs 101, whose number depends upon the clutch lever 100 being supported without play in the groove 102.

The clutch lever 100 includes an oblique surface 103, which terminates in a point 104 on one side 105 of the clutch lever 100. The point 104 lies at the center of a hole 106 that is located in the clutch lever 100. The size of the hole 106 is adapted to the diameter of the connecting rod 95 such that there is minimal play between them, so that when the clutch lever 100 is tilted slightly, a clamping is established between it and the connecting rod 95.

Figure 11:
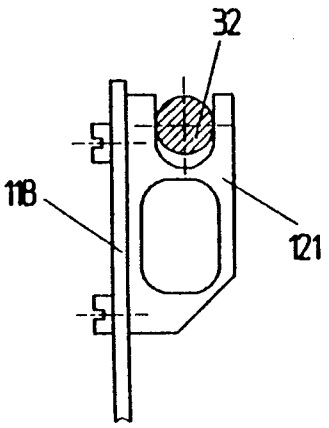
FIG. 11 is a simplified view taken along the section line R-S of FIG. 10.
Figure 12:
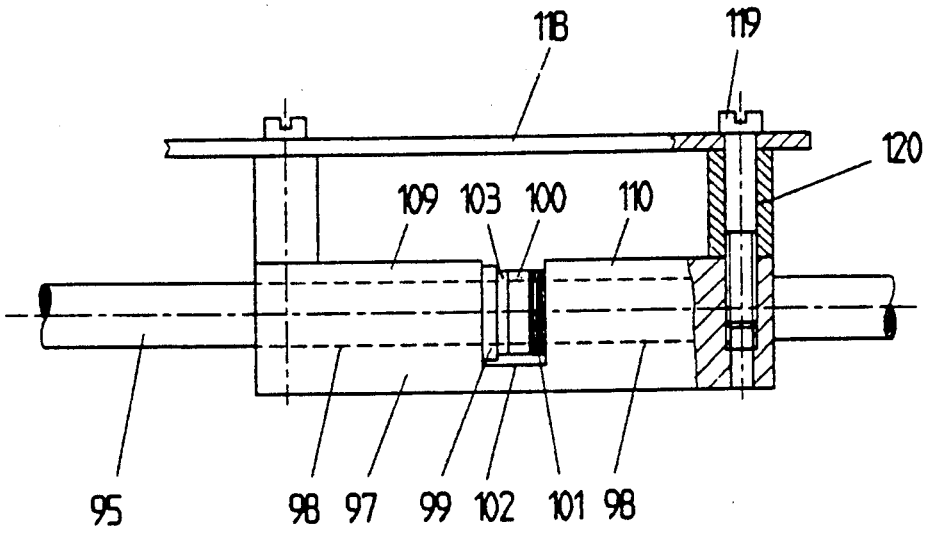
FIG. 12 is a plan view of a clutch unit in the direction of the arrow T of FIG. 10.

The hole 106 has two pocket shaped relief recesses 107, 108 which are obliquely opposite each other. Their depth is greater than half the diameter of the clutch lever 100. The relief recess 107 is provided below the point 104 and the opening of that relief recess opens into the side 105. On the bracket 97 there are further provided two protruding legs 109, 110. A blind hole 111 located in the leg 109 receives a compression spring 112. The protruding spring end presses against the side 105 of the clutch lever 100. A stop screw 113 in the leg 110 is secured in position in known manner by a lock nut 114. Furthermore, a single acting compressed air cylinder 115 is attached to the leg 110. The piston rod 116 of cylinder 115 presses against a further side 117 of the clutch lever 100. In FIGS. 10 to 12, a driver arm 118 is firmly connected to the bracket 97 by at least two screws 119 and at least two sleeves 120.

In FIG. 11, at the free end of the driver arm 118, there is fastened a fork piece 121 which engages around the guide rod 32 and is located between the two driver plates 38, 38'. Furthermore a spacer ring 122 is pushed onto the guide rod 32 between the driver plates. The width of said spacer ring is such that the fork piece 121 is arranged without play between the driver plates 38, 38'.

Referring to FIGS. 2 and 6, the pushing device 12 is attached to the arms 93 fixed to the frame. Device 12 is comprised of two double-acting compressed air cylinders 123, 124 arranged in a straight line. The compressed air cylinders are directed opposite to each other, so that their piston rods 125, 126 periodically make contact with the shock absorbers 55. At the free end of each piston rod 125, 126 there is a threaded shaft. Each shaft receives a stop nut 127, 127' and a lock nut 128, 128', which enables trouble free adjustment of the initial position of the clamping device 5.

The pressurization of all the compressed air cylinders mentioned in the foregoing description is effected, in known manner, by means of known electropneumatic components, such as magnetically actuated valves, throttle valves and the like, which are not individually described but are illustrated here for reasons of simplicity. The pressure medium is supplied from a common external source of compressed air. The functionally proper times for pressurizations as well as the duration of the pressurizations of each compressed air cylinder are made possible, also in known manner, by the electropneumatic control 8.

OPERATION

The mode of operation of the sewing unit in accordance with the invention is described below.

By actuation of a main switch 129, the sewing unit is made ready for operation. Starting from an external source of compressed air, the cylindrical holes 68 of the clamps 62, 62' are pressurized with compressed air through the hose pieces 75. This presses the piston 78 downward in FIG. 9 and the sole plate 72 is swung, against the action of the compression spring 71, around the pin 70 until the front edge of the sole plate 72 contacts the top of the layout table 56. In order to place a workpiece in the feed device 6, the operator actuates a knee switch 130, which vents the cylindrical holes 68 and the sole plates 72 are thus swung into the upraised position in FIG. 9.

Now the workpiece is spread out on the layout table 56 and aligned with a mark 131 and a front edge 132 of the layout table 56. When the workpiece has assumed its proper position on the layout table 56, the operator releases the knee switch 130. This again pressurizes the cylindrical cavities 68 with compressed air and the aligned workpiece is fixed on the layout table 56 by the descending sole plate 72. A new operating cycle is started by pressing one of the two closing switches 133, 133' only when the preceding operating cycle has been completed. This is the case if the last stitch group located in the workpiece has been sewn and the material presser has then been lifted. If the closing switch 133 or 133' is pressed during a current operating cycle, the beginning of the new operating cycle necessarily takes place after the previously described completion of the first operating cycle. Upon the beginning of the operating cycle, after appropriate pressurization of the compressed air cylinder 61, the feed device 6 is moved, in FIG. 4, from its initial position A to its advanced position B. The layout table 56 thus travels over the bearing plate 36 of the clamping device 5. When the feed device 6 has reached position B, the compressed air cylinders 46 provided on the slides 39 are pressurized, by which means the holding fingers 47 are lowered until the pressure plates 51 press on the workpiece held in the feed device 6.

Now, as described at the start, the cylindrical holes 68 are again vented, which opens the clamps 62, 62'. Thereupon, the second cylindrical cavity of the double acting compressed air cylinder 61 is pressurized. This returns the feed device 6 back to its initial position A. The free end of the workpiece 81 which is now clamped in the clamping device 5, falls downward according to FIG. 5 and partly covers the removal device 7 which is described below.

When the feed device 6 has left the zone of action of the clamping device 5, during the backward motion of the device 6 from B to A, the material presser of the stitch group sewing machine 4, which is located, for instance, in position C in FIG. 4, descends on the workpiece 81. Then, the drive unit 9, via the tension transmission 10, moves the carriage 2 and along with it the stitch group sewing machine 4 in the direction V from C to D. Simultaneously with the start of the motion of the carriage 2, the compressed air cylinder 115 of the clutch unit 11 is pressurized with compressed air and the compressed air cylinder 123 of the pushing device 12 is vented, while the compressed air cylinder 124 of the pushing device is pressurized with compressed air.

By means of the pressurization of the compressed air cylinder 115, the clutch lever 100 assumes the position in FIG. 10, which firmly clamps the clutch lever 100 on the connecting rod 95, which is firmly connected to the carriage 2. As a result, upon the start of the motion of the carriage 2 from C to D, the clamping device 5 is also moved from C to D by means of the driver arm 118. During the synchronous motion of the carriage 2 and of the clamping device 5, the stitch group sewing machine 4 executes the first stitch group sewing operation, for instance, the sewing on of a button or the sewing of a buttonhole. Upon reaching the position D, the carriage 2 and also the clamping device 5 are brought to a stop. Their immediate stopping is assured by the drive unit 9. If the stitch group sewing operation just carried out is not yet complete, it is completed while the stitch group sewing machine 4 and the clamping device 5 are at a stop. After that completion, the material presser is lifted. In the case of sewing on of a button, a new button is introduced into the button clasp developed as material presser, by means of a button feeding device known from German Patent 35 19 659. At the same time, the compressed air cylinder 123 of the pushing device 12 is pressurized. Also at the same time, the compressed air cylinder 115 of the clutch unit 11 is vented. In this way, the clutch lever 100, under the influence of the now relaxing compression spring 112, swings until it stops against the stop screw 113. In this way, the clutch unit 11 can now be displaced easily on the connecting rod 95 of the carriage 2 which is momentarily at rest. This displacement is made possible by the pressurization of the compressed air cylinder 123. In this way, the clamping device 5 is pushed oppositely to its previously executed motion, along the guide rods 31, 32, into its initial position which can be noted in FIG. 3. The initial position is reached when the shock absorber 55 located in the driver plate 38' has come against the extended piston rod 125 of the compressed air cylinder 124 which is still pressurized. Upon reaching the aforementioned initial position, the drive unit 9 now moves the carriage 2 and the clamping device 5, which clamping device is now again coupled to the carriage via the clutch unit 11, in the direction V until the stitch group sewing machine 4 has now reached the position E which can be noted in FIG. 4. After the completion of the stitch group sewing operation and the lifting of the material presser, the clamping device 5 is again uncoupled from the carriage 2 which is now at rest, and the clamping device is pushed into the previously described initial position by pressurization of the compressed air cylinder 123.

The sequences of motions just described are continued until the last stitch group to be sewn in the workpiece has been finally sewn. The control 8 stores a program which, among other things, gives information about the number of stitch groups in a workpiece and their spacing from one another. After the completion of the last stitch group sewing operation, appropriate commands are issued to the clamping device 5 and its sewing material holder 44 releases the workpiece by venting the compressed air cylinder 46. Commands are issued to the stitch group sewing machine 4 for the lifting of the material presser. Commands are issued to the removal device 7. With regard to the last-named, by pressurization of the compressed air cylinder 94, the clamp member 90 is pressed against the stacking material carrier 85, by which means the workpiece 81 is also held between the stacking material carrier 85 and the clamp member 90. Now the compressed air cylinder 89 is pressurized. This lifts the clamp member 87 upward off the stacking material carrier 85. Thereupon, the compressed air cylinder 83 is also pressurized, by which means the throw over part 82 swings between the space formed by the stacking material carrier 85 and that formed by the lifted clamp member 87. The workpiece is thus extracted from the clamping device 5 and thrown over the stacking material carrier 85. The throw over part 82 is now transferred again into the initial position which can be noted in FIG. 5, by appropriate pressurization of the compressed air cylinder 83. Now the compressed air cylinder 89 is again vented. The clamp member 87, under the influence of the tension spring 86, is again pressed against the stacking material carrier 85. Then, the clamp member 90 is again transferred to the initial position in FIG. 5, after the venting of the compressed air cylinder 94. The workpiece 81 just removed from the clamping device is thus properly stacked.

Now the entire operating cycle, which began with the placing of the workpiece in the feed device 6 and ended with the stacking of the finally sewn workpiece, is complete During this operating cycle, a further workpiece to be sewn has been placed by the operator in the proper position in the feed device 6, which is located in position A. Provided that one of the closing switches 133, 133' has been pressed after the placing, the unsewn workpiece is again transferred into the clamping device 5 and accepted it in the manner described previously. Then, the carriage 2 is intermittently moved in the direction U by the drive unit 9, the stitch group sewing machine 4 and the coupled clamping device 5 initially being moved from G to F according to FIG. 4. For this purpose, the compressed air cylinder 124 of the pushing device 12 has previously been vented. When the respective stitch group sewing operation has been completed with the stitch group sewing machine 4 located in position F and the material presser has been lifted, then, in the manner described previously, the clamping device 5 is uncoupled from the carriage 2 which is now at rest and, at the same time, the compressed air cylinder 124 is pressurized. In this way, the clamping device 5 now moves, again opposite to its previously executed motion, into its initial position which can be noted in FIG. 3. When that position has been reached, the carriage 2 and the stitch group sewing machine 4, together with the again coupled clamping device 5, move from F into the position E. These sequences of motions are also repeated until the stitch group sewing machine 4 has resumed the position C. After the completion of the last stitch group sewing operation to be executed on the workpiece just sewn, the material presser is again lifted and the workpiece is removed from the clamping device 5 by the removal device 7 and is stacked in the manner described above.

Because the operator need expend substantially less time for the placement and alignment of an unsewn workpiece than is taken up by the entire above described operating cycle requires, successive loading of two or three correspondingly set up sewing units is possible. In order to make multi-machine operation easier, the closing switches 133, 133' are arranged on both sides of the layout table 56, and these switches thus enable optimal machine operation.

In the foregoing the present invention has been described in connection with a preferred illustrative embodiment thereof. Since many variations and modifications of the present invention will now be apparent to those skilled in the art it is preferred that the scope of this invention be determined not by the specific disclosures herein contained but only by the appended claims.

What is claimed is:

1. A sewing unit for the successive production of a number of stitch groups in a workpiece, said sewing unit comprising;

a frame; a carriage supported on said frame; said carriage being intermittently displaceable in two opposite directions along said frame;

a stitch group sewing machine with sewing tools carried on said carriage, said sewing machine being equipped with a liftable material presser;

a clamping device located in the zone of action of said sewing tools for the temporary holding of the workpiece clamped in it;

a feed device provided with a mark for the aligned receiving and subsequent placing of the workpiece that is subsequently to be sewn;

a removal device for the removal of the finally sewn workpiece from the clamping device;

an electropneumatic control having a drive unit for periodically driving the stitch group sewing machine in one of two opposite directions by means of a transmission, so that said clamping device slidably supported on said frame is periodically engaged by said carriage via a clutch unit; and a pushing device for pushing said clamping device in the direction opposite to its previously executed movement into its initial position after the completion of the stitch group sewing operation.

2. A sewing unit according to claim 1, wherein said drive unit of said electropneumatic control is a frequency controlled gear motor attached to said frame, said gear motor including an output shaft carrying a first toothed belt pulley secured against relative rotation; said transmission comprising the said first toothed belt pulley, a second toothed belt pulley rotatably supported on said frame, and a toothed belt passing around the two said toothed belt pulleys.

3. A sewing unit according to claim 2, wherein said carriage has two bearing brackets, each with a slide bush provided therein, and has at least one roller; said carriage sliding, by means of said bearing brackets and said slide bushes, on a shaft firmly connected to said frame;

said roller moving on a travel strip provided on said frame; a clamp holder on said carriage for the positive connection of said carriage to said transmission; and a connecting rod firmly connected to said carriage, said rod being located close to the front faces of said bearing brackets

4. A sewing unit according to claim 1, wherein said clamping device is in operative connection with said clutch unit via a driver arm, said clamping device comprises a supporting tube, a clamp bracket provided at each end of said supporting tube, a bearing plate firmly connected to said clamp brackets, two supporting plates firmly connected to said bearing plate and having two driver plates attached to said supporting plates; two slides arranged slidably and fixed on said supporting tube, one of said slides being provided between said engagement plate and said clamp bracket and the other said slide being between said driver plate and said clamp bracket; and two end plates, each attached to an associated said clamp bracket.

5. A sewing unit according to claim 4, wherein said clamp brackets are connected to said supporting tube; each of said clamp brackets having a slide bush; each said slide comprising a plate and a sleeve firmly connected thereto, and further slide bushes pressed into that said sleeve; a sewing material holder with a lowerable holding finger attached to the plate; said end plates each having a fork shaped opening; and a shock absorber arranged on each of said driver plates.

6. A sewing unit according to claim 1, comprising a guide rod attached to said frame, said clamping device is slidably supported, by means of said slide bushes, on said guide rod and by a second guide rod fixed to said frame.

7. A sewing unit according to claim 1, wherein said clutch unit supported on the connecting rod comprises a body, a tiltable clutch lever arranged between a ring and a plurality of plate springs, and said driver arm attached to said body, said body having two protruding legs; a compression spring supported in one of said legs and the other said leg having an adjustable stop screw and a single-acting compressed air cylinder.

8. A sewing unit according to claim 7, wherein said clutch lever has a hole with two obliquely oppositely located pocket shaped relief recesses the depth of which is greater than half the diameter of said clutch lever; said clutch lever having, on one side thereof which lies opposite the point of engagement of a piston rod of said compressed air cylinder, an oblique surface which terminates at a point on said side at the center of the hole; said relief recesses being respectively below and above the point on the side; and minimal play is present between the hole and said connecting rod.

9. A sewing unit according to claim 1, wherein said pushing device comprises two compressed air cylinders, oppositely directed but arranged in a straight line, said compressed air cylinders being firmly connected to the frame via two arms; and said piston rods of the two compressed air cylinders periodically coming into operative connection with said shock absorbers.

10. In a sewing machine, a carrier for positioning a workpiece on which repetitive sewing tasks are to be performed;

said carrier being adapted for linear movement in selected opposite directions;

a sewing device mounted on said carrier and movable therewith;

a clamp mounted for linear movement parallel to said carrier and engageable with said workpiece; said clamp being movable with said carrier and engaged with a workpiece for movement of said carrier and said clamp in one direction;

sewing material holding means which maintains said workpiece under tension continuously during said repetitive sewing tasks;

said clamp being separable from said workpiece immediately before movement of said clamp in the opposite direction.

* * * * *